United States Patent [19]

Faldi

[11] 3,994,082

[45] Nov. 30, 1976

[54] AIR OPERATED DREDGING APPARATUS

[75] Inventor: Giovanni Faldi, Florence, Italy

[73] Assignee: Pneuma International S.A., Luxembourg

[22] Filed: Dec. 5, 1974

[21] Appl. No.: 530,004

[30] Foreign Application Priority Data

Jan. 4, 1974 Italy ..... 19113/74

[52] U.S. Cl. ..... 37/71; 417/122; 417/137

[51] Int. Cl.[2] ..... E02F 3/88

[58] Field of Search ..... 37/58, 59, 71, 195; 302/14, 15, 55; 417/118, 122, 137

[56] References Cited

UNITED STATES PATENTS

| | | | |
|---|---|---|---|
| 672,247 | 4/1901 | Wheeler et al. | 37/59 |
| 1,600,505 | 9/1926 | Hunter | 417/122 |
| 2,003,779 | 6/1935 | Yedd | 417/122 X |
| 3,540,194 | 11/1970 | Chaplin | 37/195 X |
| 3,552,884 | 1/1971 | Faldi | 417/122 |
| 3,624,933 | 12/1971 | Faldi | 37/71 X |
| 3,667,865 | 6/1972 | Faldi | 417/122 |
| 3,693,272 | 9/1972 | Gariel | 37/72 X |
| 3,748,760 | 7/1973 | Schnell | 37/58 |
| 3,842,522 | 10/1974 | Holzenberger et al. | 37/59 X |

*Primary Examiner*—Clifford D. Crowder
*Attorney, Agent, or Firm*—Karl W. Flocks

[57] ABSTRACT

Air operated dredging apparatus comprising a submerged pumping unit adapted to be dragged along an underwater bed which unit includes at least two pumping chambers periodically filled with loose material in admixture with water entering the chamber through a duct connecting a dredging shovel to the chamber, and emptied by feeding compressed air into the said chamber. A check valve is provided on the duct upstream of the entrance to the chamber whereby escape of air through the duct and the shovel is avoided.

4 Claims, 3 Drawing Figures

AIR OPERATED DREDGING APPARATUS

This invention relates to a dredging implementation of the kind comprising a submerged unit composed of a pump and a dredging shovel, which is usually dragged along the bottom of the water body to be dredged; the material as collected by the shovels is conveyed thereby towards the pumping cylinders, whereinto it enters due to the effect of the overlying water head, while the discharge of same takes place by the agency of compressed air as sequentially fed into the cylinders. More particularly, the present invention relates to an improvement in the dredging apparatus having the specific task of preventing the so-called secondary pollution," this term being intended to connote the phenomenon which often accompanies the dredging of polluted bottoms so that, as a result of the dredging operation as such, polluted materials are deposited on the already dredged areas again, or goes to pollute surrounding areas.

As outlined above, the dredging apparatus to which the present invention refers essentially comprise a submerged pump, formed by two or more pumping cylinders, and one or more shovels having the task of engaging the water body bottom, possibly and preferably exerting a disaggregating action consistently with the kind of the water body bottom, and to convey the material as collected from the bottom to the individual pumping cylinders.

As regards more detailedly the dredging shovels, the hitherto conventional apparatus, as used, comprise:

1. A single shovel from which one or more ducts stem to convey the dredged out material into the interior of the pumping cylinders;

2. A double shovel, adapted to ensure the dredging action in both the directions of drag of the submerged pump;

3. Individual and independent shovels for each pumping cylinder.

In all the submerged pumps, suitable valves control both the intake and the outlet of the dredged out material with respect to every pumping cylinder, as well as the introduction of compressed air for dumping said material.

On account of the difficulties which have been experienced in the past as to the control of these valves from outside, for example from the dragging punt, also through suitable automatic mechanisms, in the most up-to-date and sophisticated types of pumps there have been adopted valves which are located in the interior of each pumping cylinder and operating by gravity and/or by the hydrodynamic action of the water and/or the air entering the same cylinder.

In the case of polluted bottoms, it has been observed, however, that the apparatus of the kind referred to above can be an origin of secondary pollution.

As a matter of fact, in the majority of the cases, the polluted bottoms are constituted by materials having a certain elastic cohesion (muddy or clay-like materials), whose dredging requires a disaggregation action by the agency of shovels equipped with cutting blades or points.

If, this notwithstanding, the penetration of the shovels into the bottom is too deep, or the viscosity of the dredged out material is such as to make it difficult to obtain the flow through the conveying ducts from the shovel(s) to the pumping cylinders, it may occur that a complete filling of the pumping cylinders is not obtained, with the admixture composed by water and dredged out material.

In such a case the predetermined amount of compressed air, which is fed for discharging the cylinder and is calculated as a function of a preselected filling coefficient of the cylinder, is too high and tends to emerge through the intake valve for the dredged out material into the cylinder, a valve whose task is to prevent the dredged out material in the cylinder from escaping through the intake duct at the instant of the introduction of compressed air for emptying the cylinder.

As a matter of fact, these valves, while having a very satisfactory sealtightness in the presence of a liquid, as they operate by the action of their weight, are incapable of ensuring a tight seal in the presence of air. While, in the case of dredging of non polluted bottoms the possible loss of air through the intake valve for the dredged material does not cause any trouble, this fact becomes extremely serious when the bottom to be dredged is polluted. As is actually known, in the latter case, attempts are made in order to avoid to the greatest possible extent any movement of the bottom susceptible of bringing in suspension polluted particles, which, in their turn, are dragged by the streams towards other non-polluted or already reclaimed areas. The importance thus becomes apparent of the problem as faced by the present invention: as a matter of fact an escape of compressed air through a shovel would originate an extremely intense stirring of the surrounding bottom area along with the consequences as outlined hereinabove.

It has now been found, and this is the subject-matter of the present invention, that the problem as proposed above is virtually solved by a dredging apparatus of the kind referred to above which is characterized in that, in each connection duct between the cylinders of the pump and the shovel, a safety valve is mounted, which is adapted to intercept any leakage of air in a direction contrary to the direction of intake into the cylinder of the dredged out material admixed with water.

In the preferred embodiment of the present invention, the safety valve will be of the controlled type (by compressed air, by fluido-dynamic system, by electric controls etc.) with its operation synchronized with the compressed air distributor which controls the introduction of air into the several cylinders of the pump.

The particular aspects and the advantages of the present invention will become clearer from the ensuing description, given with reference to the accompanying drawings, wherein.

Figure 1:
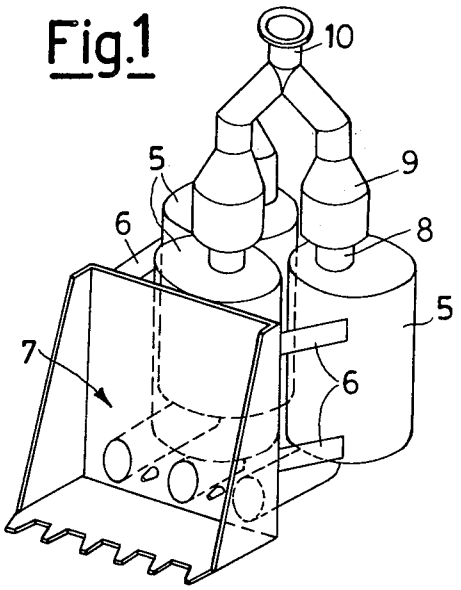
FIG. 1 is a general diagrammatical view of a pump and dredging shovel assembly.
Figure 2:
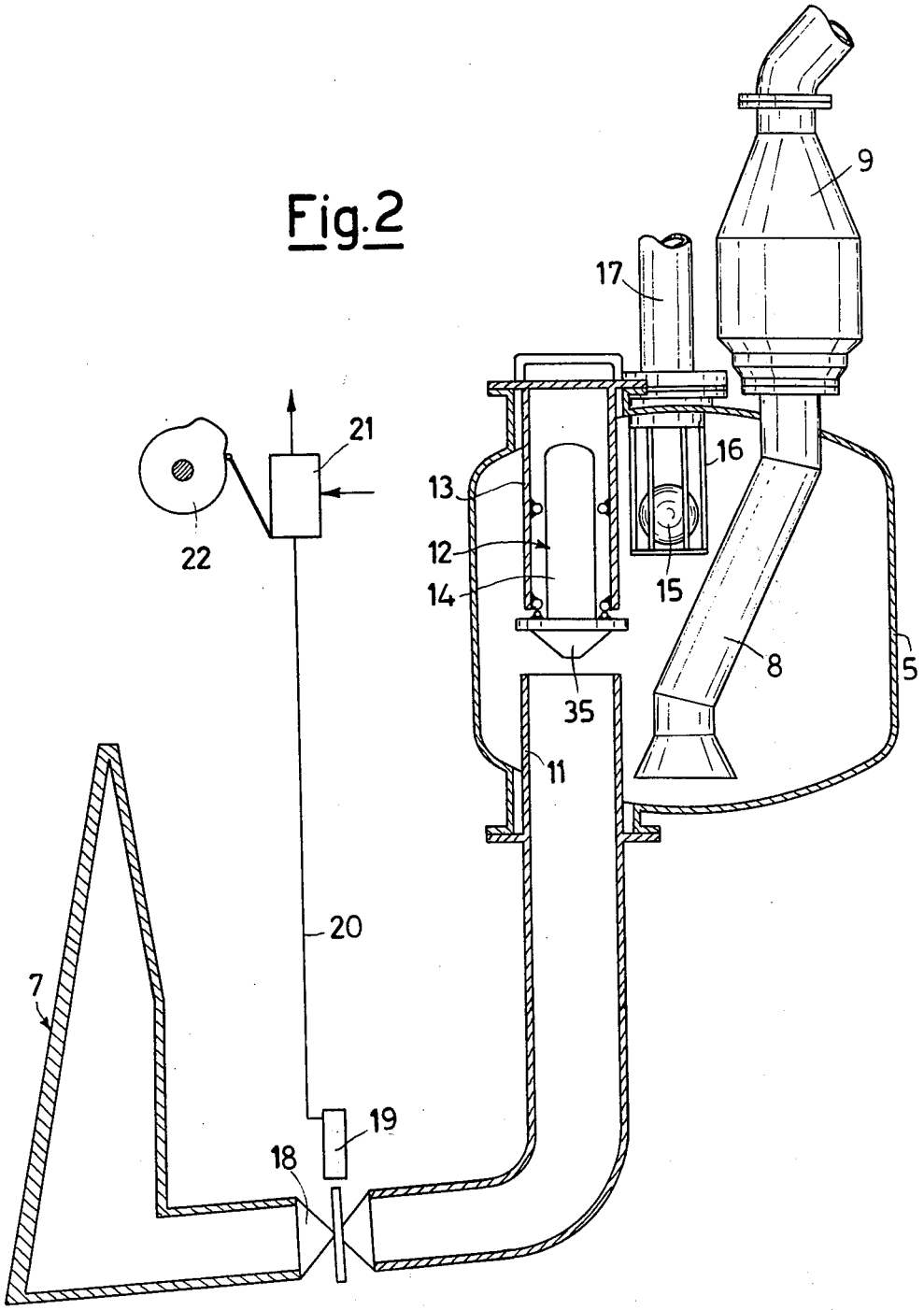
FIG. 2 is a view, partly in cross-section, of a pumping cylinder and of the shovel according to the present invention.

Referring, at the outset, to FIGS. 1 and 2, there is shown a simplified form of the pump and dredging shovel assembly, comprising three pumping cylinders 5, which are assembled together and with the dredging shovel 7 by structural members 6. Each cylinder 5 is equipped with a compressed air inlet as fed through a tube 17 and a valve formed by a cage 16 and a floating ball 15; a duct 8 for dumping the dredged out material, equipped with a valve 9, the three ducts 8 being terminated into a single outlet manifold 10, and, lastly, an intake for the material as dredged out by the shovel 7, said intake being formed, in this case, by a tube 11 which opens at a certain height of the cylinder 5 and is controlled by a poppet valve 12, the latter comprising a guiding and sustaining cylinder 13, a stem 14 and a disc 35.

It is apparent that the closure of the valve 12 takes place by gravity, whereas the opening takes place under the thrust of the material entering through the pipe 11, providing that such a thrust is not counterbalanced by the presence of compressed air of an admixture of dredged out material and water in the same cylinder.

As clearly seen in FIG. 2, the tube 11 connects the cylinder 5 to the shovel 7 and is equipped, upstream of the intake to the cylinder (with reference to the direction of flow of the dredged out material from the shovel to the cylinder), with a closing-off valve 18, which is closed whenever compressed air is fed into the cylinder 5 to dump the dredged out material through the tube 8.

In the example shown, the actuation of the valve 18 is of the fluido-dynamic type.

Now, on considering that the dredging apparatus in question are usually equipped with a compressed air distributor which is adapted cyclically to control the opening and closing of the valves for introducing compressed air into the cylinders 5 and that such a distributor is conventionally fitted with a certain number of rotatably mounted cams, in the preferred embodiment, in order to actuate the valve 18, a fluido-dynamic actuation is provided, as indicated by an actuator 19: the latter, in its turn, is pneumatically controlled by a device which is generally shown at 21 as being connected thereto by a hose or conduit 20 and as being driven by an actuation cam 22, such as a cam being preferably inserted in the compressed air distributor.

The system is so prearranged that, whenever the compressed air distributor controls the introduction of compressed air, in phase concordance with said control the cam 22 switches the device 21 so as to control the actuator 19, usually of the slide valve type for fluido-dynamic operation, to close the close-off valve 18.

Obviously, in the case where the bottom to be dredged is not polluted, it is possible to provide so that both the valve 18 and its actuator are not acted upon, that is, the valve 18 is kept completely and constantly open.

Figure 3:
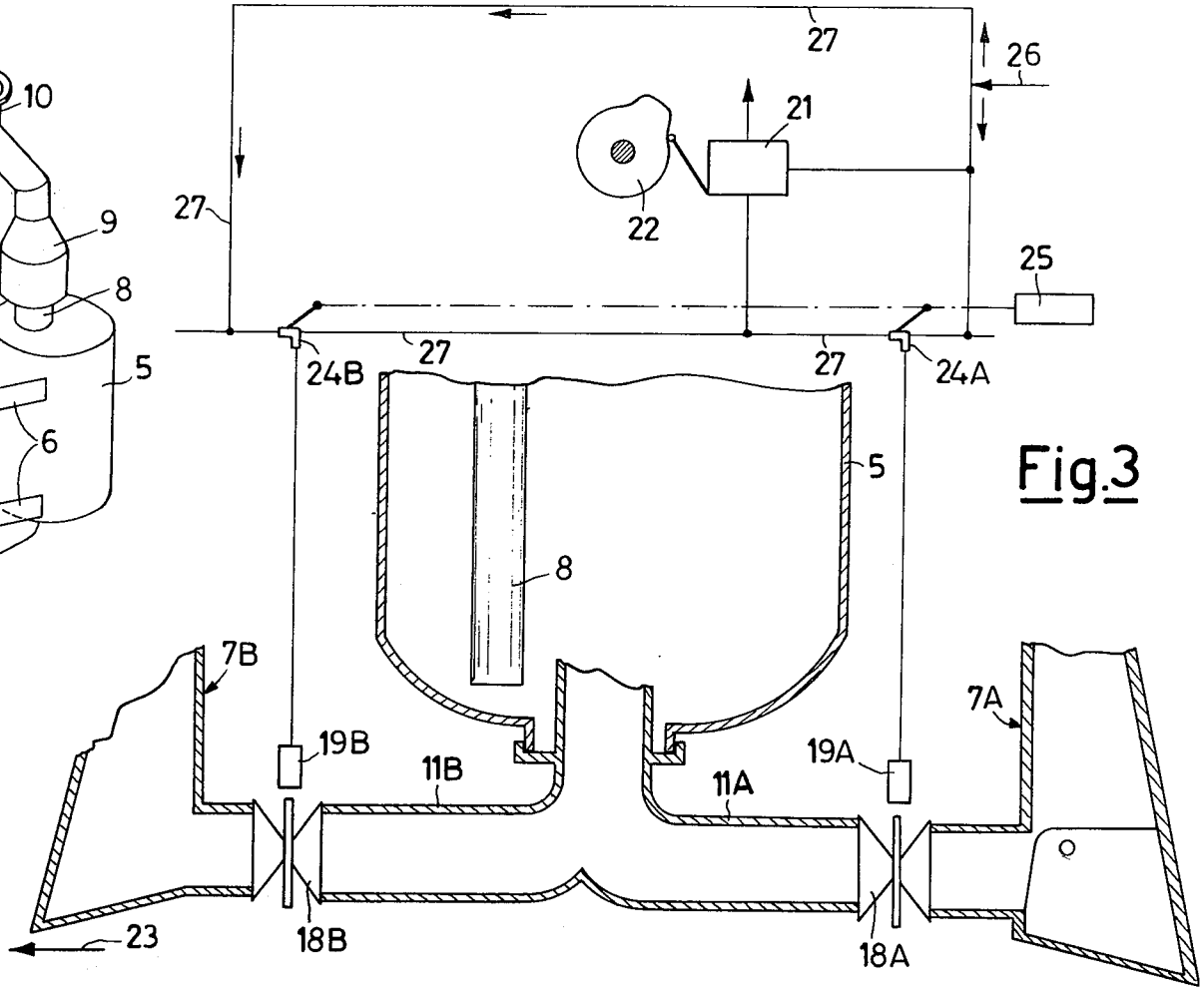
FIG. 3 is a view similar to FIG. 2, of a doubleshovel machine, as modified according to the present invention.

Coming now to consider FIG. 3, there is shown a double-shovel assembly 7A, 7B, which is adapted to dredge in either of two opposite dragging directions, the two shovels 7A and 7B being connected by respective ducts 11A, 11B, to the cylinder 5.

Within the two ducts 11A, 11B, are mounted two closingoff valves 18A, 18B, which are fitted with their respective actuators, 19A, 19B; the two actuators are controlled by a cam device 22 and by a control 21, of the kind disclosed hereinbefore. Obviously, when the drag is carried out in the direction of the arrow 23, the valve 18A should be permanently closed, whereas the valve 18B should open and close consistently with the operation cycle of the pump. To this end, the control 21 is connected to the two actuators 19A, 19B, arranged in parallel, through a switching device as identified by the two cutting-off members 24A, 24B, as controlled by a common actuator 25 (actuated either manually or through means responsive to the direction of drag), the device being such that when a cutoff member 24A or 24B is in its cutoff stage, the other is under the condition of free flow of the actuation fluid of the respective actuator 19A, 19B and vice versa.

At 26 there is shown a common feed for the actuation fluid which flows through the ducts 27. The invention has been disclosed in connection with a few preferred embodiments, it being understood that modifications and changes which are both ideally and mechanically equivalent can be introduced therein without departing from the scope of this invention.

What I claim is:

1. Compressed air operated dredging pump apparatus comprising submerged pumping chamber means for reception of dredged material, means for periodically supplying compressed air to said chamber means, intake duct connected to said chamber means including an upstream end and a downstream end, a dredging shovel connected to the upstream end of said duct for conveying dredged material to said chamber means, a first valve at the downstream end of said duct for controlling flow of dredged material into said chamber means, a second valve downstream from said shovel and upstream from said first valve, control means for closing said second valve during the entire time in which compressed air is supplied to said chamber means by said compressed air supplying means to prevent escape of air through said intake duct.

2. The apparatus defined in claim 1 wherein said chamber means comprises a first cylinder connected to said intake duct with said first and second valves, and one or more additional cylinders of like construction connected with a respective intake duct and first and second valves, each of said intake ducts being connected to said dredging shovel, and means for periodically supplying compressed air to each of said cylinders including a distributor for allowing air to enter one of said cylinders, and said control means for said second valve including a fluido-dynamic actuator and a control cam therefor which is in time phase relationship with said distributor.

3. The apparatus defined in claim 2 wherein said dredging shovel is of the double-shovel type with said shovel facing in one direction and connected to each of said cylinders through each of the respective intake ducts thereof and a second dredging shovel facing in a direction opposite from said one direction and connected to each of said cylinders by additional intake ducts, is operative in opposite drag directions, and a said second valve is mounted in each of the ducts connecting the individual shovels to the pumping cylinders.

4. The apparatus defined in claim 2 wherein said control means include a switching and actuation device operatively related to the drag direction of said apparatus so that cyclical opening and closing of said second valve of each of said cylinders takes place only when one of said second valves is associated with a shovel in operative condition in the drag direction while others of said second valves remain closed until the drag direction of the shovel associated therewith is reversed.

* * * * *